US010704281B1

(12) United States Patent
Stahlhut et al.

(10) Patent No.: US 10,704,281 B1
(45) Date of Patent: Jul. 7, 2020

(54) PORTABLE SHELTER

(71) Applicants: Conrad Stahlhut, Charlotte, NC (US); Cornelia Stahlhut, Charlotte, NC (US)

(72) Inventors: Conrad Stahlhut, Charlotte, NC (US); Cornelia Stahlhut, Charlotte, NC (US)

( * ) Notice: Subject to any disclaimer, the term of this patent is extended or adjusted under 35 U.S.C. 154(b) by 0 days.

(21) Appl. No.: 16/193,791

(22) Filed: Nov. 16, 2018

(51) Int. Cl.
*E04H 1/12* (2006.01)
*E04H 15/34* (2006.01)
*E04H 15/00* (2006.01)

(52) U.S. Cl.
CPC ..... *E04H 1/1244* (2013.01); *E04H 15/003* (2013.01); *E04H 15/34* (2013.01)

(58) Field of Classification Search
CPC ..... E04H 15/003; E04H 15/34; E04H 1/1244
USPC ..... 220/9.1, 9.2, 9.3
See application file for complete search history.

(56) References Cited

U.S. PATENT DOCUMENTS 1,599,798 A * 9/1926 Stockton ..... E04H 1/1244 135/115
1,803,626 A * 5/1931 Lasley ..... E04H 1/1244 135/118
1,990,804 A * 2/1935 Watson ..... E04H 1/1244 135/128
2,458,246 A * 1/1949 Brereton ..... A47J 47/18 220/630
5,379,466 A 1/1995 Davies
5,528,849 A * 6/1996 Plinta ..... A01M 31/025 135/126
5,592,961 A * 1/1997 Chin ..... E04H 1/1244 135/117
5,735,608 A * 4/1998 Branco ..... A45C 3/00 190/903
6,431,393 B1 * 8/2002 Stewart ..... B65D 33/02 220/213
6,786,793 B1 * 9/2004 Wang ..... A63H 3/06 40/412
7,849,866 B1 * 12/2010 Mangum ..... A47K 11/04 135/117
8,485,209 B2 * 7/2013 Imhof ..... E04H 15/54 135/126
9,758,986 B1 * 9/2017 Moore ..... E04H 15/44
9,932,752 B1 * 4/2018 Vila ..... A45F 3/02
10,113,328 B1 * 10/2018 Polisar ..... E04H 15/48
(Continued)

*Primary Examiner* — David R Dunn
*Assistant Examiner* — Danielle Jackson
(74) *Attorney, Agent, or Firm* — Sanchelima & Associates, P.A.; Christian Sanchelima; Jesus Sanchelima

(57) ABSTRACT

The present invention is a portable shelter for providing private while outdoors. The portable shelter comprises a cover and a supporting frame arranged inside the cover. The portable shelter is disposed in a collapsed state when the supporting frame is in a tensioned position, and in an installed state when the supporting frame is released from the tensioned position. The portable shelter includes a zipper extending at least partially along a vertical length of the cover to provide ingress and egress to interior space of the portable shelter when in the installed state. The portable shelter further comprises one or more retaining straps to hold the supporting frame in the tensioned position, when the portable shelter is in the collapsed state. The portable shelter further comprises two or more feet for supporting the supporting frame on the ground, while the portable shelter is in the installed state.

11 Claims, 2 Drawing Sheets

(56) References Cited

U.S. PATENT DOCUMENTS

| | | | | |
|---|---|---|---|---|
| 2002/0030052 | A1* | 3/2002 | Joo-Tai | A45C 7/0077 220/9.2 |
| 2003/0015528 | A1* | 1/2003 | Schneider | A45C 7/0077 220/9.2 |
| 2003/0106895 | A1* | 6/2003 | Kalal | B65D 21/086 220/9.2 |
| 2004/0155038 | A1* | 8/2004 | Smith | B65D 33/02 220/9.2 |
| 2005/0034748 | A1* | 2/2005 | Gadd | E04H 1/1244 135/126 |
| 2005/0284866 | A1* | 12/2005 | Oakner | B65F 1/02 220/9.2 |
| 2010/0155397 | A1* | 6/2010 | Zheng | D06F 95/002 220/9.1 |
| 2012/0060881 | A1* | 3/2012 | Ly-Cho | E04H 1/1244 135/121 |
| 2013/0340159 | A1* | 12/2013 | Barrett | A47K 3/325 4/599 |
| 2015/0047118 | A1* | 2/2015 | Bilyk, Jr. | A47K 3/325 4/608 |
| 2015/0184378 | A1* | 7/2015 | Silva | E04H 15/003 160/351 |
| 2018/0094449 | A1* | 4/2018 | Batushanskiy | E04H 15/30 |
| 2020/0018089 | A1* | 1/2020 | Moon | E04H 1/1244 |

* cited by examiner

PORTABLE SHELTER

BACKGROUND OF THE INVENTION

1. Field of the Invention

The present disclosure generally relates to portable building structures and, in particular, to a collapsible shelter with foldable design for use as a changing room and/or as a private restroom while outdoors.

2. Description of the Related Art

Outdoor recreation activities have flourished in the past few decades, and an increasing number of individuals are camping, hiking and going to beaches for recreation. Generally, commercial or public campgrounds provide toilet, shower and changing facilities. However, an increasing number of people prefer to camp away a significant distance from the public facilities at the campground. Such campgrounds may not provide toilet facilities or private chambers for use as a changing room out of view of other campers, or persons around. Furthermore, people are travelling more in general. This has generally been made possible because of convenience of having a vehicle for travelling long distances by road trips. However, if a person has to visit the bathroom during a road trip, it generally becomes a big problem if there is no toilet nearby.

Conventional portable toilets are impractical due to their large size, weight, or hardware components necessary to assemble into a self-supporting structure, making them inconveniently, unsuitable and impractical aboard cars, campers and similar recreational vehicles and vessels due to a lack of space. For instance, pop-up tents are known to have been employed as portable toilet and/or portable clothing changing room. The convenience and simplicity of pop-up tents make them popular for use in outdoor environments. When extended, a pop-up tent forms a characteristic dome shape that has a low vertical span relative to the volume of interior space enclosed within the pop-up tent. While this is appropriate for most purposes, when the pop-up tent is used for activities requiring a person to stand upright, such as changing clothes, a pop-up tent can take up a lot of area relative to the requirements of the activity.

Applicant believes that a related reference corresponds to Expired U.S. Pat. No. 5,379,466 (hereinafter referred to as '466 patent) which discloses a portable privacy closet which may be selectively moved from a raised to a lowered position such that when the closet is in the raised position it provides a private area for use as a changing room or for housing a toilet facility, and when in the lowered position, the closet provides a weather-tight storage area. The portable privacy closet includes a base having a pair of parallel spaced apart sidewalls, a rear wall, a bottom wall and a front wall, which includes a door which seals to the front wall when in the closed position. A top portion telescopically engages the base and includes a pair of parallel spaced apart sidewalls, a rear wall and a front wall formed with an access opening, selectively closed by either a curtain or a door. The top portion is selectively moved into and out of telescopic engagement with the base via a plurality of cables attached at a first end to a spool supported by the base, and attached at a second end to the top portion such that rotation of the spool causes the top portion to raise out of telescopic engagement with the base.

Although the portable privacy closet of '466 patent may provide some convenience as to assembly of the structure due to its modularity but it is still far free from a person to assemble and disassemble quickly as may be required during a road trip for a quick clothing change or bathroom break. Furthermore, the portable privacy closet of '466 patent is generally meant to be installed in a space more or less permanently which is not desirable for the said applications. Therefore, there is a need of a structure which can be used as a private restroom for bathroom break and even a private space for clothing change that is easy to install and easy to use.

Documents describing the closest subject matter provide for a number of more or less complicated features that fail to solve the problems described above in an efficient and economical way. None of the documents suggest the novel features of the present invention.

SUMMARY OF THE INVENTION

It is one of the main objectives of the present invention to provide a portable shelter which can be used as a private restroom and/or for providing privacy when changing clothes outdoors and in public.

It is another objective of the present invention to provide a portable shelter which can be installed and collapsed quickly for storage and transportation with no need for special skills or manual dexterity It is still another objective of the present invention to provide a portable shelter which provides thermal, wind, and rain protection in cold climates while changing in public and is sufficiently rigid for general use at camps, beaches and other public places.

It is yet another objective of the present invention to provide a portable shelter which could be manufactured in a range of sizes, with each size being large enough to accommodate the physical movements required by a user to disrobe and put on clothing freely and safely therein.

It is yet another objective of the present invention to provide a portable shelter which is compact, portable, lightweight, durable and inexpensive to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
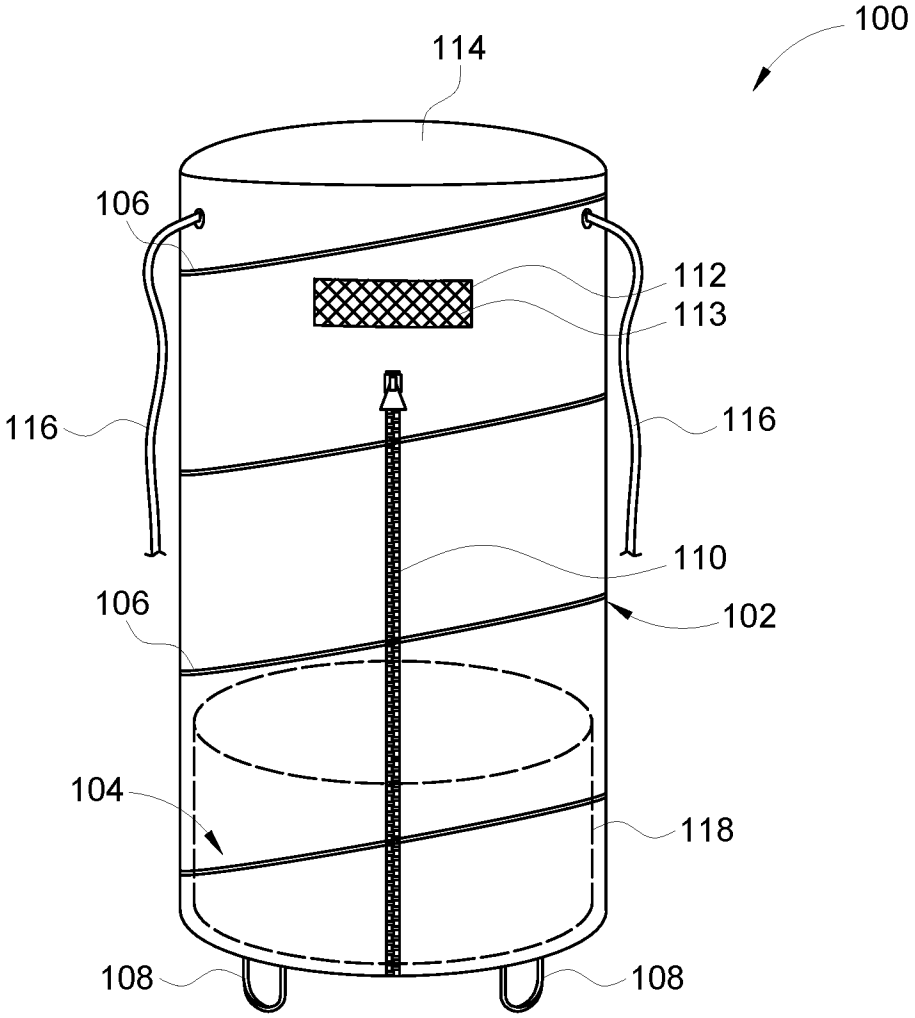
FIG. 1 illustrates a diagrammatic perspective view of a portable shelter 100 in an installed state thereof, in accordance with one or more embodiments of the present invention.
Figure 2:
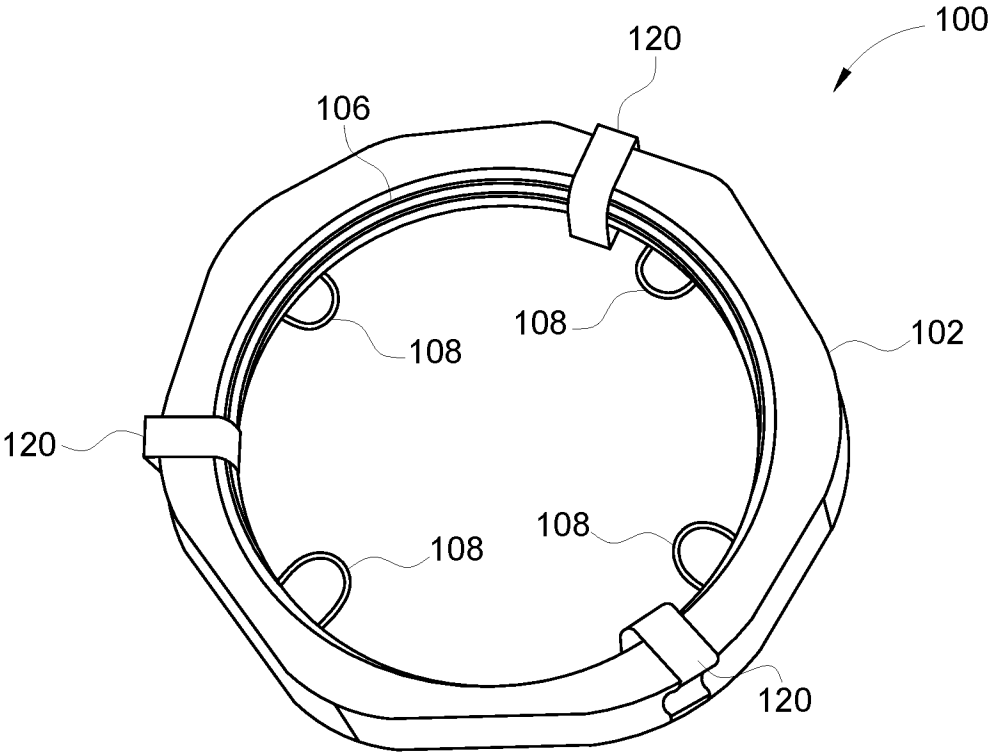
FIG. 2 illustrates a diagrammatic perspective view of the portable shelter 100 of FIG. 1 in a collapsed state thereof, in accordance with one or more embodiments of the present invention.

Referring to the drawings, FIGS. 1-2 illustrate diagrammatic views of a portable shelter (referred by the numeral 100), in accordance with one or more embodiments of the present invention. The portable shelter 100 is a self-erecting structure that is deployed to create a private space within a public setting. The portable shelter 100 enables a person to change clothing, go to the bathroom, and perform other personal tasks in a private manner while outdoors in a public or the like. In this respect, before explaining the current embodiments of the portable shelter 100 in detail, it is to be understood that the portable shelter 100 is not limited in its applications to the details of construction and arrangements of the components set forth in the following description or illustration. Those skilled in the art will appreciate that the concept of the present disclosure may be readily utilized as a basis for the design of other structures, methods, and systems for carrying out the several purposes of the portable shelter 100.

FIG. 1 illustrates the portable shelter 100 in an installed state thereof. As discussed, the portable shelter 100 is a self-erecting structure that can be popped-up to create a private space for suitable applications while outdoors. For this purpose, the portable shelter 100 includes a cover 102 and a supporting frame 104. The supporting frame 104 is a collapsible structure that supports the cover 102. While in the installed state of the portable shelter 100, the cover 102 encloses the supporting frame 104 for the purpose of creating the private space. As illustrated in FIG. 1, the cover 102 may completely wrap around the supporting frame 104. It may be understood that the cover 102 may generally be a piece of cloth. In the present embodiments, the supporting frame 104 may be a spring or a coil loaded structure to provide stiffness to the supporting frame 104 for supporting the cover 102 thereon, while the portable shelter 100 is in the installed state.

In one or more examples, the supporting frame 104 may include one or more coils 106. The coils 106 are stored in a tension bearing state while the supporting frame 104 is in a collapsed state (as illustrated in FIG. 2). This configuration allows the portable shelter 100 to use the energy stored within each of the coils 106 to expand the supporting frame 104. The coils 106 within the supporting frame 104 are arranged inside the cloth of the cover 102 such that the coils 106 will cause the supporting frame 104 to extend into a tubular or cylindrical shaped structure (as shown in FIG. 1) without need of any human intervention. Although, the supporting frame 104 has been described in terms of having more than one coils 106, it may be appreciated that, in other examples, the supporting frame 104 may have one continuous coil without any limitations.

Further, as illustrated, the portable shelter 100 may include two or more feet 108 to support the supporting frame 104, while in the installed state. In the present examples, the portable shelter 100 includes four number of feet 108 (as better shown in FIG. 2) arranged substantially equidistantly along circumference at a bottom of the supporting frame 104. In one or more examples, the feet 108 are foldable wire feet which are arranged in an extended vertical manner when the portable shelter 100 is in the installed state, and otherwise in a folded or bent horizontal manner when the portable shelter 100 is in the collapsed state. The feet 108 may be made of bendable wires which may be easily bent or folded by application of some force to be transformed from a folded position to an unfolded position, and vice-versa. Such foldable wire feet are well known in the art and thus have not been described in detail herein. In one exemplary configuration, the feet 108 may be designed to support the supporting frame 104 about 5 inches from the ground, or to be pushed into the ground, as required for supporting the portable shelter 100 in the installed state.

Further, as illustrated in FIG. 1, the portable shelter 100 may include a zipper 110 extending at least partially along a vertical length of the cover 102. As may be understood, the zipper 110 may be opened to provide ingress and egress into the portable shelter 100 when in the installed state, and closed to prevent access to interior space thereof. The zipper 110 may be regular zipper as known in the art. In some other examples, the zipper 110 may be replaced by ties or knots without any limitations. Further, the portable shelter 100 may include two lookout windows 112 (only one shown in the accompanied drawings) arranged diametrically opposite along the supporting frame 104, while the portable shelter 100 is in the installed state. The windows 112 may be arranged right above the zipper 110, as shown in FIG. 1. In one exemplary configuration, the windows 112 may measure about 10 inches wide and about 3 inches tall. In some examples, the windows 112 may be provided with shields 113 for each of the two windows 112. In one example, the shields 113 may in the form of a mesh, a curtain or the like. The shields 113 may be arranged on the inside wall of the cover 102, around the windows 112, to close off the windows 112 when required for complete privacy of the interior space in the portable shelter 100.

Further, as illustrated, the portable shelter 100 may include a dome cover 114. The dome cover 114 may generally be hemispherical in shape. The dome cover 114 is placed on top of the cover 102 to fully cover the interior space of the portable shelter 100. It may be understood that the dome cover 114 may protect the interior space of the portable shelter 100 from rains and the like. Also, as illustrated, the portable shelter 100 may have two or more tethers 116 which may be attached to and extending from the cover 102 proximal to top thereof. In the illustrated embodiments, the two or more tethers 116 are shown to include two ropes. Such ropes may measure about 2-4 feet in length. The tethers 116 are used to tie and restrain the cover 102, and thereby the portable shelter 100, to a tree or some other object if necessary, so as to provide stability to the portable shelter 100 in the installed state, for example, in case of high winds or the like.

In an embodiment of the present disclosure, the portable shelter 100 is provided with a splash-guard liner 118 arranged in the interior space of the cover 102. In particular, the splash-guard liner 118 may be arranged along a bottom third of the height of the cover 102. The splash-guard liner 118 may be made of plastic or similar material. The splash-guard liner 118 may be employed for using the portable shelter 100 as a private restroom, for example, so that the user may use the portable shelter 100 as a toilet for urinating inside thereof, without worry of splashes being bounced therefrom. The splash-guard liner 118 may be removably arranged in the interior space of the cover 102 when required. In one example, the splash-guard liner 118 may be attached to inner wall of the cover 102 by means of quickly detachable fasteners, such as Velcro™. Such arrangement allows the splash-guard liner 118 to be removed from the interior space for cleaning the same after use, as and when required.

As discussed earlier, FIG. 2 illustrates the portable shelter 100 in the collapsed state. The portable shelter 100 includes retaining straps 120 to hold the supporting frame 104 and the cover 102 in position, when the portable shelter 100 is placed in the collapsed state. The retaining straps 120 may be in the form of bands or webbings that holds the coils 106 of the supporting frame 104 in tensioned position, when the portable shelter 100 is in the collapsed state. The retaining straps 120 may or may not be elastic. The retaining straps 120 are wrapped around the cover 102 and the supporting frame 104, when the portable shelter 100 is in the collapsed position. The retaining straps 120 may further include some form of locking means (not shown), such as a buckle or the like, to constrain against and restrict the tension force of the coils 106, while the portable shelter 100 is in the collapsed position.

In one or more exemplary configuration, the cover 102 may have dimensions with a height of about 6-7 feet when extended fully, and further a diameter of about 3-5 feet to allow a user to conveniently stand inside the interior space of the portable shelter 100, such as for purpose of changing clothing and/or for urinating and the like. In general, the portable shelter 100 may be manufactured in a range of sizes, with each size being large enough to accommodate the physical movements required by a user to disrobe and put on clothing freely and safely in the interior space thereof, when in the installed state. In the present examples, the cover 102 of the portable shelter 100 may be made of vinyl and plastic materials which are generally opaque to provide privacy to the user. Furthermore, the cover 102 may be made of dark materials to further enhance opaque effect.

It may be contemplated that when the portable shelter 100 is needed for use, the user first loosens the retaining straps 120, unfolds the feet 108 and extends the supporting frame 104 by slightly pulling the coils 106, so that the cover 102 stands vertically as a tall tube. The user may then unzip the zipper 110 to access interior space inside the cover 102 and place the splash-guard liner 118 therein if required. The user may further unzip the zipper 110 for privacy during use. After use, the user may get out from the interior space by unzipping the zipper 110 and stepping out, push down the coils 106 and then locks the retaining straps 120 to again dispose the portable shelter 100 in the collapsed state, for example for transportation to some other place or the like.

The portable shelter 100 of the present disclosure provides a private way to change clothing, go to the bathroom, and perform other personal tasks while outdoors. The portable shelter 100 conceals the user completely for privacy. The portable shelter 100 is compact, portable, versatile, lightweight and easy to use, i.e. to be disposed between the collapsed state and the installed state, and vice-versa. The portable shelter 100 is ideal for long-distance trips, hiking, camping, backpacking, beach visits, road trips, parties, BBQs, etc. In some examples, the portable shelter 100 may be used as changing rooms which are commonly used in the clothing industry to allow patrons to try on clothes prior to selecting the clothes, for example, at remote locations such as sidewalk sales, yard sales and the beach. The portable shelter 100 promotes convenience, relief, and peace of mind for the user as it ensures provision of a private space when required.

The foregoing description conveys the best understanding of the objectives and advantages of the present invention. Different embodiments may be made of the inventive concept of this invention without affecting the scope of the present disclosure. It is to be understood that all matter disclosed herein is to be interpreted merely as illustrative, and not in a limiting sense.

What is claimed is:

1. A portable shelter, comprising:

a collapsible cover configured to be used as a privacy enclosure in public, wherein said collapsible cover is a tubular fabric body;

a supporting frame arranged inside the collapsible cover, wherein the portable shelter is disposed in a collapsed state when the supporting frame is in a tensioned position, and wherein the portable shelter is disposed in an installed state when the supporting frame is released from the tensioned position;

four feet for supporting the supporting frame on the ground, while the portable shelter is in the installed state, wherein said four feet are mounted on a bottom end of said supporting frame, wherein said bottom end of said supporting frame is circular in shape, wherein said four feet are spaced apart equidistantly along a circumference of said supporting frame, said four feet being a curved rod having a U-shape each and having a first end and a second end, wherein said first and second ends are mounted along said circumference of said supporting end, wherein said four feet include a hollow portion therein;

a zipper entrance, wherein said zipper entrance extends vertically from a bottom most end of said supporting frame up to a predetermined space below a lookout window, wherein said zipper entrance is mounted perpendicularly to said lookout window, wherein said zipper entrance is mounted in between two of the said four feet of said bottom end of said supporting frame, wherein said zipper entrance is mounted along the outer surface area of said collapsible cover, wherein the location of said zipper entrance provides a user with an efficient location to enter and exit said portable shelter, wherein the zipper entrance is adapted to be opened to provide ingress and egress into an interior space of the portable shelter when in the installed state, and closed to prevent access to the interior space thereof; and three retaining straps to hold the supporting frame in the tensioned position, when the portable shelter is in the collapsed state, wherein said three retaining straps are mounted along the outer circumference of said supporting frame in its collapsed state, wherein said three retaining straps wrap entirely around said supporting frame in its collapsed state.

2. The portable shelter of claim 1, wherein the supporting frame comprises one or more internal supports being coils stored in the tensioned position, when the supporting frame is in the collapsed state.

3. The portable shelter of claim 1, wherein said three retaining straps are in the form of bands to restrain one or more coils of the supporting frame in the tensioned position.

4. The portable shelter of claim 1, wherein the feet are foldable wire feet adapted to be extended when the portable shelter is in the installed state, and to be folded when the portable shelter is in the collapsed state.

5. The portable shelter of claim 1, wherein the collapsible cover wraps around the support frame.

6. The portable shelter of claim 1, wherein the collapsible cover is formed of generally opaque cloth material made of one or more of vinyl and plastic.

7. The portable shelter of claim 1 further comprising a splash-guard liner removably arranged in the interior space along an inner wall of the collapsible cover.

8. The portable shelter of claim 1 wherein said lookout window includes a shield mounted along the outer surface are of said lookout window, wherein said shield is a mesh material covering said lookout window.

9. The portable shelter of claim 1 further comprising a generally hemispherical dome cover placed on top of the collapsible cover, while the portable shelter is in the installed state.

10. The portable shelter of claim 1 further comprising two or more tethers attached to and extending from the collapsible cover proximal to top thereof.

11. A portable shelter, comprising:

a collapsible cover formed of generally opaque cloth material;

a supporting frame having one or more coils arranged inside the collapsible cover, wherein the portable shelter is disposed in a collapsed state when the supporting frame is in a tensioned position, and wherein the portable shelter is disposed in an installed state when the supporting frame is released from the tensioned position;

four foldable wire feet arranged substantially equidistantly along a bottom circumference of the supporting frame for supporting the supporting frame on the ground, while the portable shelter is in the installed state;

a zipper entrance, wherein said zipper entrance extends entirely from a bottom end of said collapsible cover up to a predetermined space below a lookout window, wherein said zipper entrance is mounted in between two of the said four feet of a bottom end of said supporting frame, wherein said zipper entrance is mounted along an outer surface area of said collapsible cover, wherein the location of said zipper entrance provides a user with an efficient location to enter and exit said portable shelter, wherein the zipper entrance is adapted to be opened to provide ingress and egress to an interior space of the portable shelter when in the installed state, and closed to prevent access to the interior space thereof;

a splash-guard liner removably arranged in the interior space along an inner wall of the collapsible cover; and one or more retaining straps to hold the supporting frame in the tensioned position, when the portable shelter is in the collapsed state.

* * * * *